US008757038B2

(12) United States Patent
Siegismund

(10) Patent No.: US 8,757,038 B2
(45) Date of Patent: Jun. 24, 2014

(54) METHOD FOR PRODUCING AN UPPER PART OF A SHOE, IN PARTICULAR OF A SPORTS SHOE

(75) Inventor: Andreas Siegismund, Kulmbach (DE)

(73) Assignee: Puma SE, Herzogenaurach (DE)

( * ) Notice: Subject to any disclaimer, the term of this patent is extended or adjusted under 35 U.S.C. 154(b) by 0 days.

(21) Appl. No.: 13/982,113

(22) PCT Filed: Jan. 13, 2012

(86) PCT No.: PCT/EP2012/000135
§ 371 (c)(1),
(2), (4) Date: Jul. 26, 2013

(87) PCT Pub. No.: WO2012/100912
PCT Pub. Date: Aug. 2, 2012

(65) Prior Publication Data

US 2013/0305465 A1 Nov. 21, 2013

(30) Foreign Application Priority Data

Jan. 27, 2011 (DE) ..... 10 2011 009 641

(51) Int. Cl.
*D04C 3/48* (2006.01)

(52) U.S. Cl.
USPC ..... 87/34

(58) Field of Classification Search
USPC ..... 87/34; 12/146 C, 146 CK
See application file for complete search history.

(56) References Cited

U.S. PATENT DOCUMENTS

| | | | | |
|---|---|---|---|---|
| 3,985,159 | A | 10/1976 | Townsend | |
| 4,519,290 | A * | 5/1985 | Inman et al. | 87/7 |
| 4,690,850 | A | 9/1987 | Fezio | |
| 4,846,908 | A * | 7/1989 | Aldrich et al. | 156/148 |
| 5,016,516 | A * | 5/1991 | Aldrich et al. | 87/8 |
| 5,203,249 | A * | 4/1993 | Adams et al. | 87/34 |
| 5,388,497 | A * | 2/1995 | Akiyama et al. | 87/34 |
| 5,398,586 | A * | 3/1995 | Akiyama et al. | 87/6 |
| 5,476,027 | A * | 12/1995 | Uchida et al. | 87/29 |
| 5,619,903 | A * | 4/1997 | Rogers et al. | 87/7 |
| 5,979,288 | A * | 11/1999 | Gallagher et al. | 87/36 |
| 6,024,005 | A * | 2/2000 | Uozumi | 87/34 |
| 7,093,527 | B2 * | 8/2006 | Rapaport et al. | 87/34 |
| 8,061,253 | B2 * | 11/2011 | Wybrow | 87/13 |
| 2002/0160068 | A1 * | 10/2002 | Nakamura | 425/112 |
| 2003/0089000 | A1 | 5/2003 | Tseng | |
| 2004/0237760 | A1 * | 12/2004 | Shimizu | 87/34 |
| 2010/0043253 | A1 | 2/2010 | Dojan | |

(Continued)

FOREIGN PATENT DOCUMENTS

| | | | |
|---|---|---|---|
| DE | 2319822 | A1 | 10/1973 |
| DE | 2441839 | A1 | 3/1975 |

(Continued)

*Primary Examiner* — Shaun R Hurley
(74) *Attorney, Agent, or Firm* — Lucas & Mercanti, LLP

(57) ABSTRACT

The method produces an upper part of a shoe, in particular a sport shoe, with enhanced wearing comfort. The method entails supplying a shoe last, which corresponds to the inner shape of the upper part of the shoe to a radial braiding machine having an annular creel, which is designed for weaving and/or braiding along three axes; Guiding the at least one shoe last through the center of the creel and simultaneously weaving and/or braiding along three axes using a fiber material around the outer circumference of the shoe last; and Terminating the weaving and/or braiding and removing the woven and/or braided material from the shoe last.

9 Claims, 4 Drawing Sheets

(56) References Cited

U.S. PATENT DOCUMENTS

| | | | | |
|---|---|---|---|---|
| 2010/0052203 | A1* | 3/2010 | Inazawa et al. | 264/103 |
| 2010/0083815 | A1* | 4/2010 | Inazawa et al. | 87/1 |
| 2010/0107346 | A1 | 5/2010 | Aveni | |
| 2010/0107443 | A1 | 5/2010 | Aveni | |
| 2010/0135816 | A1 | 6/2010 | Cairo | |
| 2010/0170990 | A1* | 7/2010 | Wybrow | 244/123.8 |
| 2013/0133508 | A1* | 5/2013 | Masson et al. | 87/34 |

FOREIGN PATENT DOCUMENTS

| | | | |
|---|---|---|---|
| DE | 2548129 | A1 | 5/1976 |
| DE | 10 2004 017 311 | A1 | 11/2005 |
| EP | 0 736 624 | A1 | 10/1996 |
| FR | 776 638 | A | 1/1935 |
| FR | 2 306 649 | A1 | 11/1976 |
| WO | 03/016036 | A2 | 2/2003 |

* cited by examiner

METHOD FOR PRODUCING AN UPPER PART OF A SHOE, IN PARTICULAR OF A SPORTS SHOE

CROSS-REFERENCE TO RELATED APPLICATIONS

This application is a 371 of PCT/ER2012/000135 filed Jan. 13, 2012, which in turn claims the priority of DE 10 2011 009 641.8 filed Jan. 27, 2011, the priority of both applications is hereby claimed and both applications are incorporated by reference herein.

The invention relates to a method for producing an upper part of a shoe, in particular of a sport shoe.

FIELD OF THE INVENTION

It is known to produce upper parts of a shoe in a classical way from a laminar material, e.g. from leather or a textile material. In this connection the material will be clutched over a shoe last and sewed after the cut of an accordant part of the material. In US 2003/0089000 A1 an upper part of a shoe is cut out from a tubular formed knit fabric which is then connected with a sole.

BACKGROUND OF THE INVENTION

The sewing of the upper part of the shoe constitutes a certain effort, which effort leads to accordant costs. Furthermore, it is disadvantageous that natural unconformity areas occur at the seam regions, so that the wearing comfort can be influenced negatively according to the seam regions.

Furthermore, by the joining of the cut material only a limited stability of the upper part of the shoe will be achieved.

In addition the known producing methods for the upper part of a shoe make the application of special material at least difficult, for example of carbon fiber material, glass fiber material or plastic fiber material, which materials would be occasionally desirable.

SUMMARY OF THE INVENTION

It is an object of the invention, to create a method for the production of an upper part of a shoe, which doesn't comprise the mentioned disadvantages. Accordingly it shall be possible, to enable the producing process very cost-efficient. Furthermore, the wearing comfort shall be increased in that manner, that seam regions in the upper part of the shoe shall be prevented as far as possible. The stability of the upper part of the shoe and with it of the whole shoe shall be high. The use of fiber material, particularly of carbon fibers, glass fibers or plastic fibers, shall be possible likewise.

The solution of this object by the invention is characterized in that the producing method for the shoe upper comprises the following steps:

a) Supplying of a shoe last, which corresponds to the inner shape of the upper part of the shoe at least widely which is to be produced;

b) Applying a radial braiding machine having an annular creel, which is designed for weaving and/or braiding along three axes;

c) Guiding the at least one shoe last through the center of the creel and simultaneously weaving and/or braiding along three axes using a fiber material, and therefore woven and/or braided material positions itself around the outer circumference of the shoe last;

d) Once the at least one shoe last has been guided through the center of the creel: Terminating the weaving and/or braiding and removing the woven and/or braided material from the shoe last;

e) Further processing the woven and/or braided material to complete the shoe, wherein the at least one shoe last is arranged directly or indirectly at the end of a manipulator arm of a manipulator and the shoe last is guided during execution of step c) by means of the manipulator.

A lining can be arranged on the shoe last prior to the execution of step c), which lining is surrounded by the woven and/or braided material produced in accordance with to step c). This lining can be pre-fabricated, e.g. knitted or sewed. A special solution suggest that the lining is produced by guiding the shoe last through the center of the annular creel and simultaneously carrying out the three axes weaving and/or braiding process, wherein another, especially a softer fiber material is used than during the execution of step c). Accordingly, the lining can thus be produced in the same manner as the shoe upper part as a pre-operation during the production of the shoe upper part. By doing so, it can be done without sewing operations completely, apart from cleaning operations.

According to a further embodiment of the method the degree of density of the woven and/or braided material can be changed along the longitudinal direction of the shoe of the shoe last. For example, a higher density of the texture and of the shoe upper part respectively can be aimed for here in the forefoot region and in the heel region than in the middle region of the shoe. Thereby, the degree of density can be changed by varying the velocity of transition of the shoe last through the center of the annular creel and/or the rotational speed of the annular creel and its bobbins which are arranged on it respectively is changed.

Before the removal of the woven material from the shoe last according to step d) the woven and/or braided material can be sprayed with a fixation medium, which fixation medium creates an adhesive connection between the individual fibers. Hereby, a higher rigidity of the upper part of the shoe can be achieved and it can be prevented that it collapses during removal from the shoe last and the further processing.

A special embodiment of the invention provides several shoe lasts in longitudinal direction of the shoe behind each other, wherein those shoe lasts are guided through the center of the annular creel without interruption of the weaving and/or braiding process. Thus, several upper parts of the shoe are produced simultaneously with a plurality of shoe lasts.

The continuing of the process of the woven respectively braided material according to step e) comprises preferably at least an attachment, particularly a gluing, of a sole at the bottom side of the woven respectively braided material of the upper part of the shoe.

As a fiber material for the production of the shoe upper part a material can be used, which is or comprises a carbon fiber, a glass fiber or a plastic fiber.

Thus, the invention intercepts on the idea that a shoe last—preferably guided by a manipulator and therefore automatically—will be guided through the center of a radial braiding machine. The radial braiding machine executes the three axes weaving respective braiding process and surrounds herewith the shoe last with a woven respective braided material, which material is attached accurately fitting on the lasts. After removal of this material from the shoe last the upper part, which is produced in this way, will be continued in the process until to the finished shoe. The upper part therefore doesn't comprise any seam.

It shall be emphasized, that the three axes weaving respective braiding method itself is not object of the present idea, but is known as such. Thus, reference is made explicit to publications, in which the mentioned method is described in a detailed way, particularly to WO 03/016036 A2, to DE 23 19 822 A1, to DE 24 41 839 A1, to DE 25 48 129 C2, to EP 0 736 624 A1 and to U.S. Pat. No. 3,985,159.

Other solutions are shown in FR 776 638 A, in U.S. Pat. No. 3,985,159 A, in US 2010/107443 A1, in EP 0 736 624 A1, in FR 2 306 649 A1 and in DE 24 41 839 A1.

In an advantageous way the upper part of the shoe can be produced substantially without seams in one single production step (maybe apart from the beginning and the end area of the woven material, where the material has to be closed respectively finished). Because the produced upper part of the shoe, which is insofar designed as one-piece, doesn't comprise any seams, it provides therefore a high wearing comfort.

Also, due to the one-piece design of the upper part of the shoe a high degree of stability will be provided.

A specific economical production can be achieved, when several successively arranged lasts are guided cohesive through the center of the radial braiding machine.

It is furthermore advantageous, that the density of the upper part material varies along the longitudinal axis of the shoe and can be adjusted to desired measures.

A yarn will be preferably used for the weaving respectively braiding process, which yarn comprises carbon fibers, glass fibers or plastic fibers and will be formed by such respectively. The method can be executed of course also with classical textile fibers (twine etc.).

The shoe last can be adjusted in its form in such a way, that for shoe elements, which have to be inserted, enough material is provided, e.g. for a shoe tongue in the area of the instep.

BRIEF DESCRIPTION OF THE DRAWINGS

In the drawing an embodiment of the invention is illustrated. It shows.

DETAILED DESCRIPTION OF THE INVENTION

Figure 1:
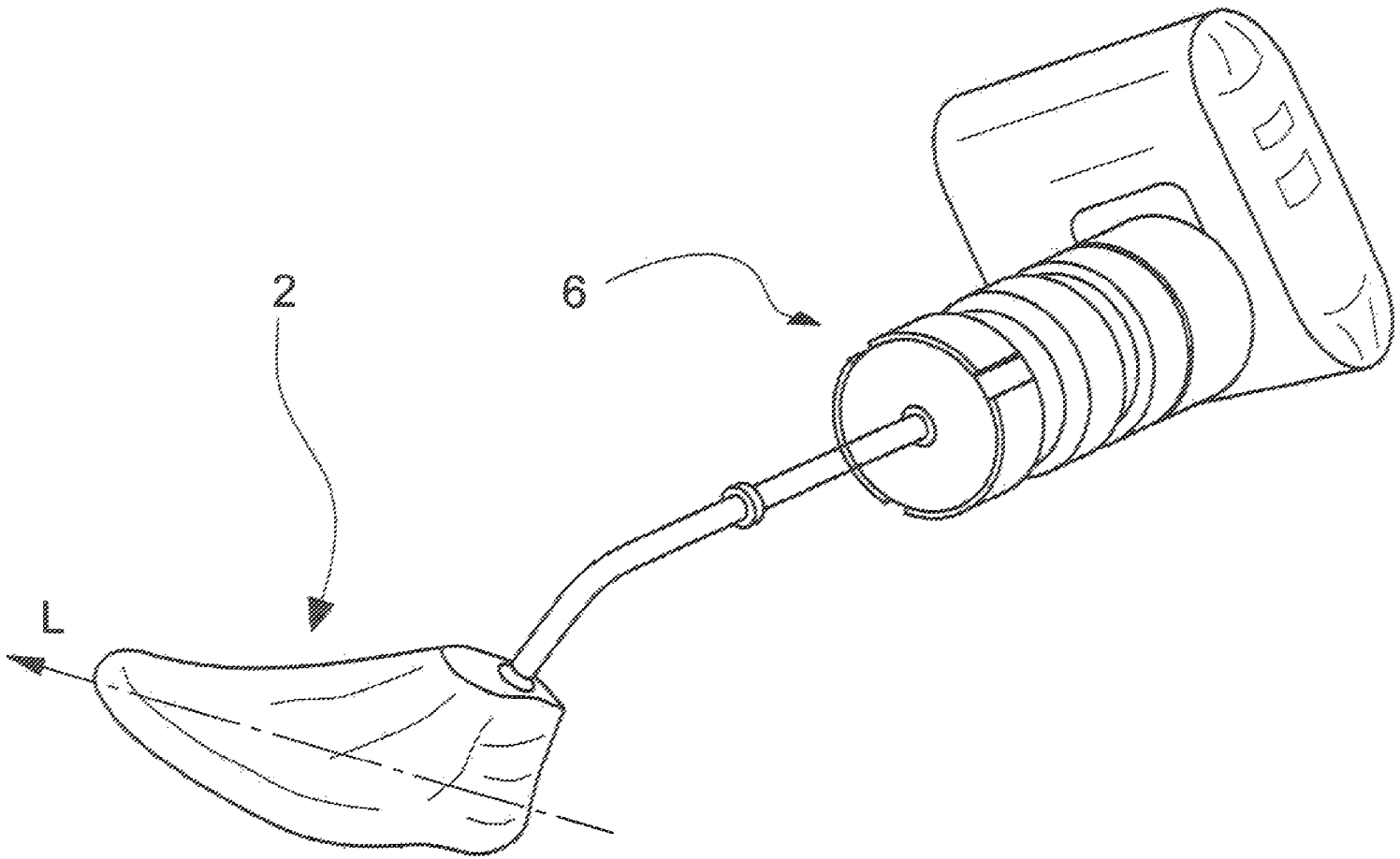
FIG. 1 in a perspective view a shoe last which is arranged at the end of a manipulator arm of a manipulator, FIG. 2 a perspective view a radial braiding machine for carrying out of the weaving and/or braiding process along three axes together with a manipulator, FIG. 3 an explosion view of a shoe and FIG. 4 the shoe according to FIG. 3 in the finished state.
Figure 2:
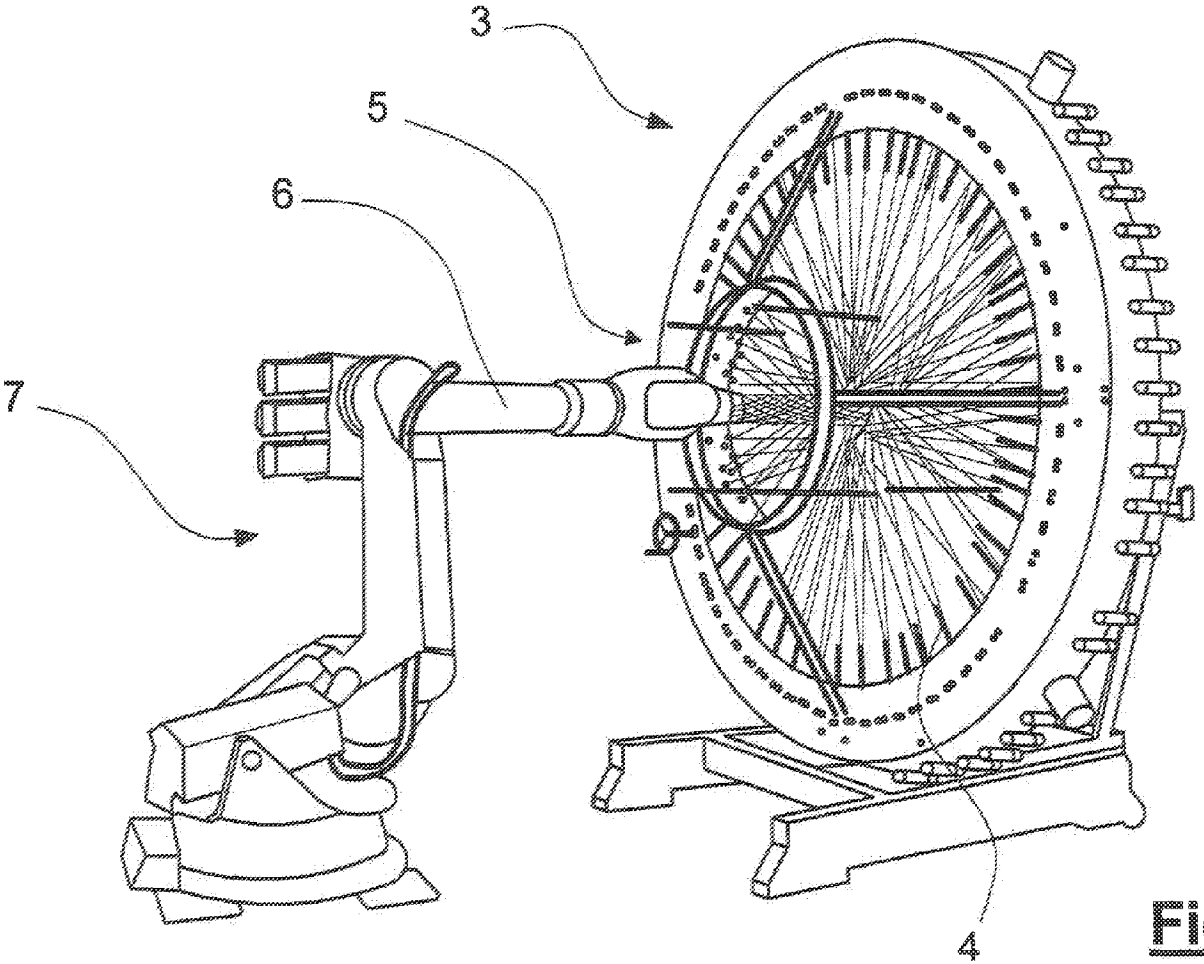
Figure 3:
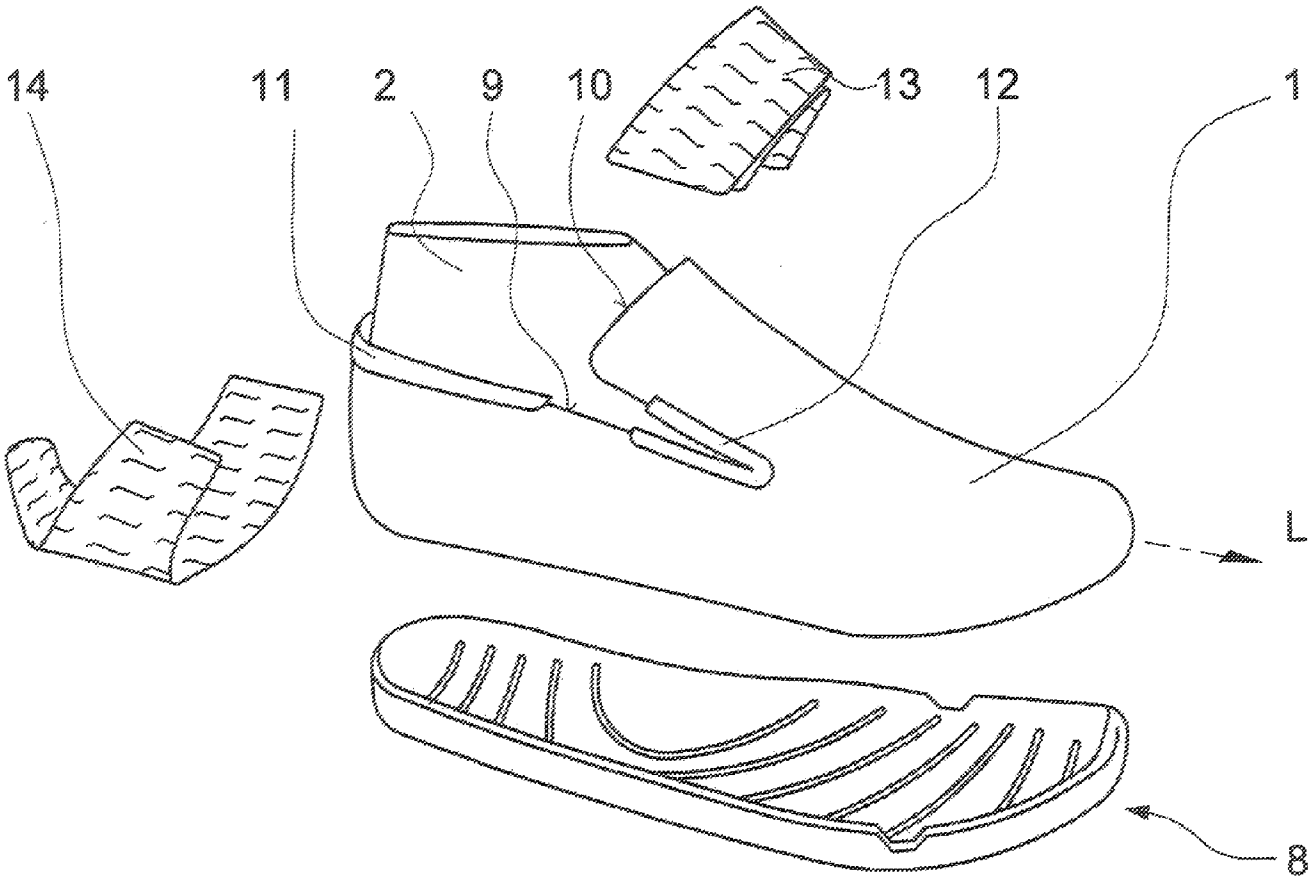

In FIG. 1 and FIG. 2 a device can be seen, which serves for the producing of an upper part 1 of a shoe, as it can be seen in FIG. 3. The device comprises a radial braiding machine 3, which is known as such; reference is made to the above mentioned publications, which define the structure and the function of such a machine.

The radial braiding machine 3 comprises a circular annular creel 4, around which circumference an amount of bobbins is arranged, on which bobbins each one is wound up with a yarn. The yarns of the different bobbins will be guided to a center 5, where the three axes braiding process occurs.

A further component of the equipment is a manipulator 7, which comprises a manipulator arm 6, on which end a shoe last 2 is arranged—as can be seen in FIG. 1. The shoe last 2 defines a longitudinal direction of the shoe L.

At the production of the upper part 1 of the shoe by means of the three axes braiding, it is proceeded in such a manner that the shoe last 2, which is arranged at the manipulator arm 6, is driven ahead into the center 5 of the radial braiding machine. Thereby, the individual axes of the manipulator are controlled in such a way, that the shoe last 2 is guided through the center 5 in such a manner that the shoe last 2 is pushed forward centrally in the center 5 in longitudinal direction L of the shoe, while the braiding process is accomplished at the same time.

Accordingly, the fibers and/or yarns respectively of the bobbins apply themselves on the outer circumference of the shoe last 2, so that an upper part 1 is created, which is accurately fitting to the shoe last 2 and is free from any seams.

It is also possible, to move the shoe last 2 at the manipulator arm 6 in such a way during the braiding process, that the longitudinal direction L of the shoe will swiveled little by little upwards, as further the shoe last 2 is pushed through the center 5.

After the braiding process the shoe last 2 is surrounded completely with braided material.

Figure 4:
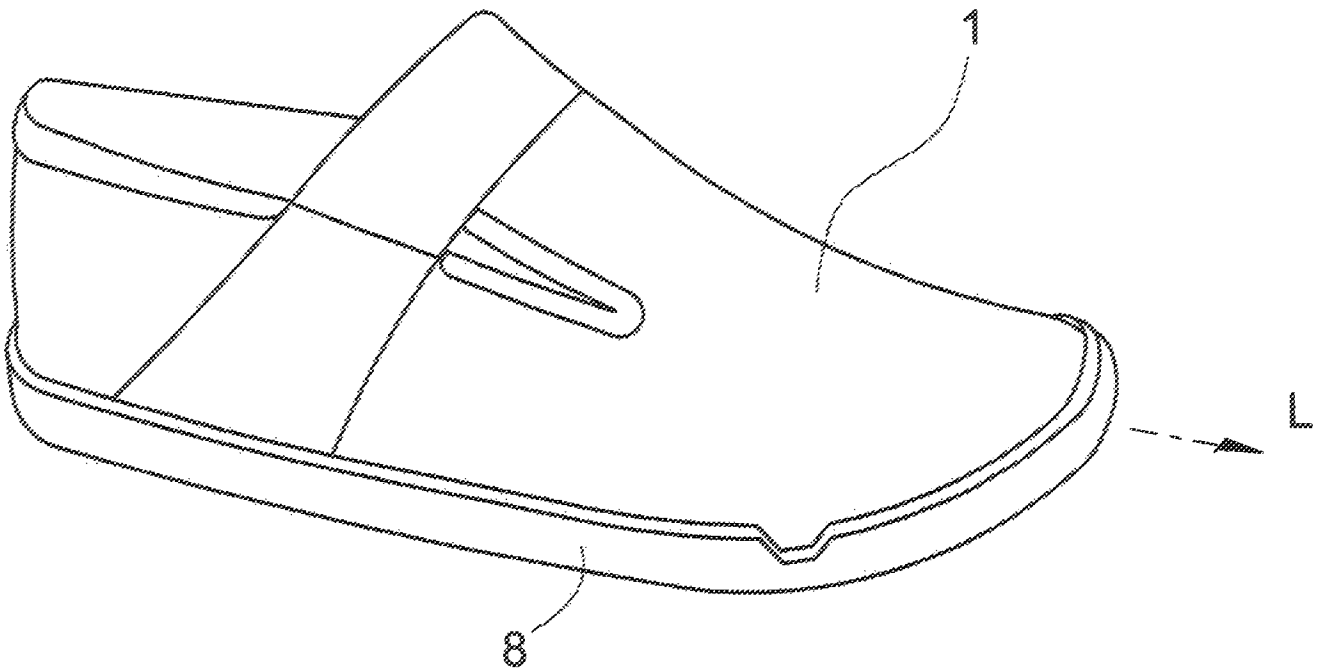

From the synopsis of FIGS. 3 and 4 it arises, how the further manufacturing of the upper part to the finished shoe occurs. In FIG. 3 it can be seen, how certain areas of the upper part 1 were cut off, to keep that upper part 1, which can be seen in FIG. 3. Accordingly an incision 9 exists on the upper part 1, which incision extends from the heel until about the center of the shoe. Likewise an incision 10 has been realized in the instep area.

Here, edge parts 11 and 12 can be fixed—e.g. glued—so that a clean and soft ending is obtained.

Before the realizing of the incisions an adhesive medium can be sprayed on the upper part to stabilize it. Hereby, it can be prevented that the material of the upper part becomes fibrous at the cut areas. The adhesive medium can if applicable also be removed in a later process step after the completion of the upper part and of the shoe respectively.

Finally, a top part 13 and a socle part 14 will be applied, e.g. glued on, which consist of an elastic material. A possible material for the top part 13 and the socle part 14 is natural rubber. After this has been carried out, a sole 8 will be applied from the bottom side onto the upper part 1, wherein a glue process can be applied again.

Hence, the finished shoe has occurred, as it can be seen in FIG. 4.

If the shoe shall have a lining, this can be clutched on the last prior the mentioned three axes braiding process. An alternative possibility exists therein, to execute the mentioned braiding process first with a softer yarn, so that the lining is braided on the shoe last. Afterwards the braiding process will be repeated with a stronger yarn, e.g. with a carbon fiber yarn, glass fiber yarn or plastic fiber yarn (a textile yarn is of course also possible), wherefore the shoe last 2—now with braided lining—will be guided again through the radial braiding machine 3 in the defined way.

The mentioned carbon fiber yarns, glass fiber yarns or plastic fiber yarns are only a preferred possibility for the producing of the upper part of the shoe; with respect to plastic fiber yarns polyamide yarn have proved itself in particular. A further proven material is a natural flax fiber, of which the upper part of the shoe can be produced. Also, classical yarns can be used as they are sufficiently known for shoes.

LIST OF REFERENCES

1 Upper part
2 Shoe last
3 Radial braiding machine
4 Annular Creel
5 Center
6 Manipulator arm

7 Manipulator
8 Sole
9 Incision
10 Incision
11 Edge part
12 Edge part
13 Top part
14 Socle part
L Longitudinal direction of the shoe

The invention claimed is:

1. A method for producing an upper part of a shoe, comprising the steps:

a) arranging at least one shoe last, which corresponds to the inner shape of the upper part of the shoe which is to be produced, directly or indirectly at an end of a manipulator arm of a manipulator;

b) applying a radial braiding machine having an annular creel, which is designed for weaving and/or braiding along three axes;

c) guiding, by means of the manipulator, the at least one shoe last through the center of the creel and simultaneously weaving and/or braiding along three axes using a fiber material, and therefore woven and/or braided material positions itself around the outer circumference of the shoe last;

d) terminating, once the at least one shoe last has been guided through the center of the creel, the weaving and/or braiding and removing the woven and/or braided material from the shoe last;

e) further processing the woven and/or braided material to complete the shoe.

2. The method according to claim 1, characterized in that a lining is arranged on the shoe last prior to the execution of step c), which lining is surrounded by the woven and/or braided material produced in accordance with to step c).

3. The method according to claim 2, characterized in that the lining is produced by guiding the shoe last through the center of the annular creel and simultaneously carrying out the three axes weaving and/or braiding process, wherein another, softer fiber material is used than during the execution of step c).

4. The method according to claim 1, characterized in that the degree of density of the woven and/or braided material is changed along the longitudinal direction of the shoe (L) of the shoe last.

5. The method according to claim 4, characterized in that the degree of density is changed by varying the velocity of transition of the shoe last through the center of the annular creel and/or the rotational speed of the annular creel and its bobbins respectively is changed.

6. The method according to claim 1, characterized in that before the removal of the woven material from the shoe last according to step d) the woven and/or braided material is sprayed with a fixation medium, which fixation medium establishes an adhesive connection between the individual fibers.

7. The method according to claim 1, characterized in that several shoe lasts are arranged successively in longitudinal direction of the shoe (L), wherein the several shoe lasts are guided through the center of the annular creel without interruption of the weaving and/or braiding process.

8. The method according to claim 1, characterized in that the further processing of the woven and/or braided material according to step e) comprises at least an attachment, a gluing, of a sole at the bottom side of the woven respectively braided material of the upper part.

9. The method according to claim 1, characterized in that as a fiber material for the production of the shoe upper part a material is used, which comprises a carbon fiber, a glass fiber or a plastic fiber.

* * * * *